US005775692A

United States Patent [19]

Watts et al.

[11] Patent Number: 5,775,692

[45] Date of Patent: Jul. 7, 1998

[54] GAMING OR AMUSEMENT MACHINES

[75] Inventors: Ronald Arthur Watts, Cardiff; Alan Parker, South Glamorgan, both of United Kingdom

[73] Assignee: Astra Innovations Ltd., Mid Glamorgan, United Kingdom

[21] Appl. No.: 771,418

[22] Filed: Dec. 20, 1996

[51] Int. Cl.[6] ..... A63F 5/04

[52] U.S. Cl. ..... 273/143 R

[58] Field of Search ..... 273/143 R

[56] References Cited

U.S. PATENT DOCUMENTS

| | | | |
|---|---|---|---|
| 4,241,920 | 12/1980 | Hooker | 273/143 R |
| 4,508,345 | 4/1985 | Okada | 273/143 R |
| 5,259,616 | 11/1993 | Bergmann . | |

FOREIGN PATENT DOCUMENTS

| | | |
|---|---|---|
| 1129607 | 10/1968 | United Kingdom . |
| 2 169 737 | 7/1986 | United Kingdom . |
| 2 222 712 | 3/1990 | United Kingdom . |
| 2 226 907 | 7/1990 | United Kingdom . |

*Primary Examiner*—William H. Grieb
*Attorney, Agent, or Firm*—Young & Thompson

[57] ABSTRACT

A gaming or amusement-with-prizes machine has two stage or multi-stage operation. Conveniently, it takes the form of a fruit machine, and a first reel spin produces a combination of symbols on a line. One or more of these combinations enable the reels to be spun again, as part of the same play or game, resulting in another combination of symbols on the line. One particular combination achieved in this way will generate a major prize, while others may produce lesser prizes.

11 Claims, 1 Drawing Sheet

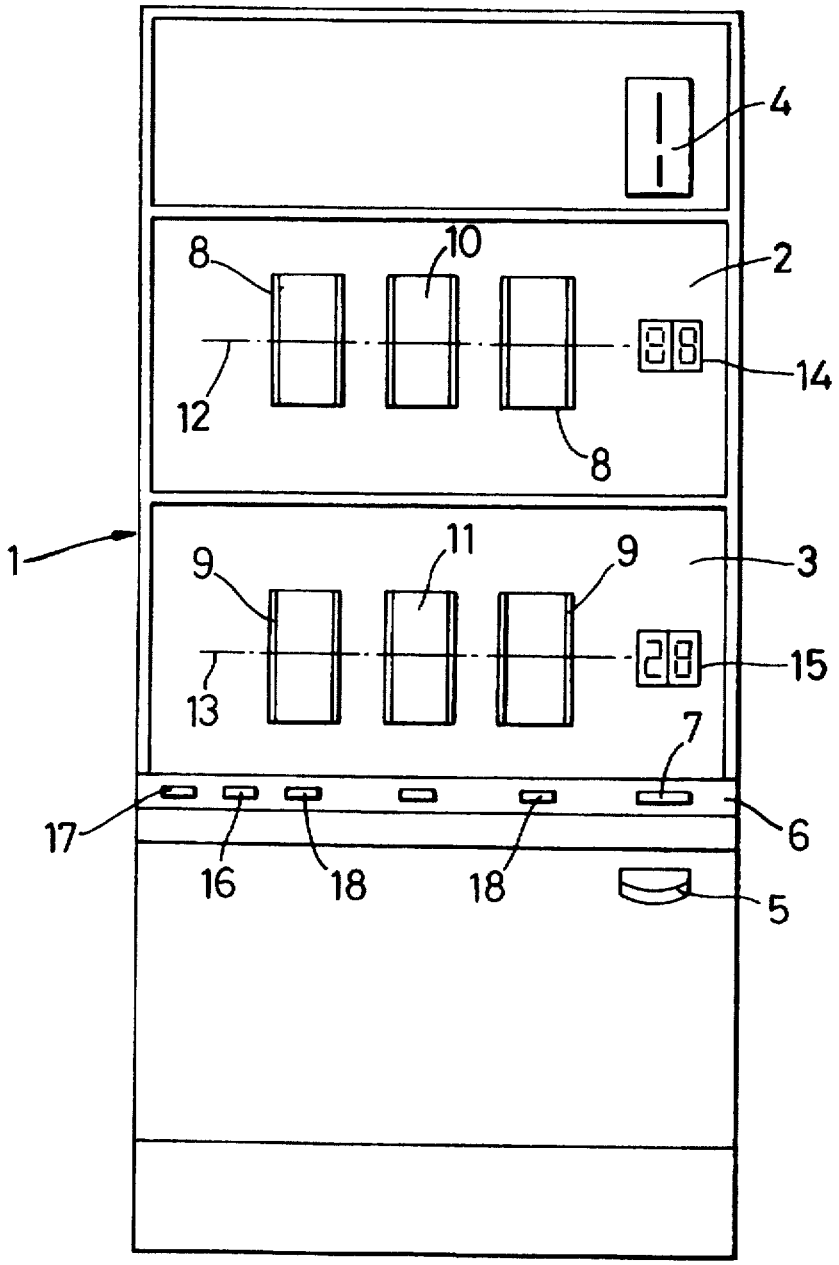
4
8
10
2
14
12
8
1
9
11
9
3
15
13
7
17
6
16
18
18
5

GAMING OR AMUSEMENT MACHINES

This invention relates to gaming or amusement machines.

It is concerned with those commonly known as fruit machines which have co-axial side-by-side reels (usually three) which spin and stop in a random or apparently random manner to show a line of symbols (conventionally mostly fruit) in respective windows. Certain combinations of symbols generate prizes, which are paid out by the machine.

These prizes have to be restricted in accordance with the number of reels and the number of different symbols on each reel. Obviously, the greater these numbers, the longer the odds against a particular symbol combination coming up on the win line, and the larger the prize can be. However, there is a limit to the size of the reels and consequently a ceiling for the top prize.

The higher this ceiling, the more attractive the machine is to many players. It is therefore the aim of this invention to increase its level far beyond what can ordinarily be expected of a machine with normal reels.

According to the present invention there is provided a gaming or amusement machine having a first random selector which, on enablement by player insertion of a coin or token, is operable to produce any of a first plurality of results, and a second random selector which is operable when a particular one or more of said first plurality of results is obtained to produce a second plurality of results, at least one of these generating a major prize.

The two-stage characteristic could be extended to three or more stages, each with its associated random selector. Progression up the stages depends each time on achieving a particular result in the random selection process.

The award of prizes is not necessarily limited to the later stage(s). Certain results from the first random selector may generate minor prizes, and a prize may be awarded in addition to the chance to operate the second random selector.

Preferably the first random selector is a set of reels arranged and playable in fruit machine manner. Access to the second random selector, which is also conveniently a set of fruit machine reels, may be achieved only if the equivalent to a jackpot is won on the first set. Alternatively, access may be broadened by also allowing it whenever certain lesser winning combinations are achieved on the first set of reels. In those circumstances, although the second set of reels can be played, the very top prize can be arranged to be unattainable. That would be won only when the first set of reels stopped at its own unique top prize combination.

Alternatively, the player may be offered several spins of the second set of reels if the first set stops at a top winning combination, but a lesser number of spins if the first set produces a lesser winning combination. Known features such as 'nudging' and 'holding' could be provided for each set of reels. Also, when there is a win from the first set of reels that would enable second stage play, there may be an option for the player to take a prize from that win and forfeit the right to play the second stage, or to go for that further play and forfeit the first stage prize in the hope of a larger one.

The number of reels in the first set need not be the same as the number of reels in the second set. Neither does the number of symbol positions around the reels of the first set have to be the same as the number of such positions around the reels of the second set. It could be arranged that the order of play be reversed, at the choice of the player or as determined by the machine, so that the second set of reels is spun first and acts like the normal first set, to determine whether that first set is playable or not.

However, the machine could be simplified by having just one set of reels which would act as the random selector for each stage.

Although mostly described in terms of reels, it will be understood that there are other random selectors, such as discs or electronic reel simulators, which could serve equally well.

For a better understanding of the invention, reference will now be made, by way of example, to the accompanying drawing.

The single FIGURE is a front view of a gaming or amusement-with-prizes machine.

The machine is housed in a cabinet 1 having display panels 2 and 3, a coin or token entry slot 4 near the top, a payout pocket 5 lower down, and a shelf 6 below the lower panel with various central buttons including a start button 7. It may be preferred that instead of a button, starting may be accomplished by a pull handle.

Each display panel has a set of three side-by-side windows 8 and 9 in which peripheral portions of reels 10 and 11 appear, these bearing symbols which are visible through the windows. When the reels are at rest, three symbols align across the centres of each set of windows on win lines represented by chain dotted lines 12 and 13. Symbols immediately above and below those on the win lines are also visible.

The panels will display instructions for playing the machine, a table of prizes to be won, and be decorated with graphics intended to attract players. They will generally be back-lit with constant and/or flashing lights, as is conventional in this art. There are also indicators 14 and 15 to show the players' credit (how many coins or tokens he has loaded and not yet spent on plays) and the amount of prize money won when a winning combination of symbols is achieved.

It will be understood that the number of reels may differ, they may not be of the same size (so that one set has more symbols per reel than the other), and the symbols on one set need not match those on the other.

Assuming the machine is in credit, as shown by indicator 14, a player can set one set of reels spinning, say the lower set 11, by pressing the button 7. The reels of that set come to a stop, usually one by one, in a random or apparently random manner. The symbols on the line 13 determine what happens next.

If certain losing combinations appear, that is the end of the play.

If a certain winning combination appears on the line 13, the play can be continued. Either the other set of reels 10 are set spinning automatically, or the player is invited, by a lit sign on one of the panels for example, to press the button 7 again (or another button) This would spin the reels 10. Either way, these reels come to a stop to leave a combination of symbols on the line 12.

If there is one particular combination, this generates a jackpot prize which, because of the much longer odds against its occurrence, can be very much more substantial than that obtainable from a jackpot win from a machine with just one set of reels.

Other combinations may generate lesser prizes, and there may be a small prize just for getting to play the second set of reels, so that whatever the outcome of the second spin, the player will win something.

On the other hand, if the second spin is not automatic, the player may be given a choice at the end of a successful first spin either to go for a second spin (which might net him nothing) or take an intermediate prize, by pressing button 16.

An alternative or additional reward for a successful first spin is to allow more than one spin of the second set of reels, the number being dependent on what symbol combination is achieved on the first set. For example a 'top' combination might allow three second reels spins, a lesser one or ones two spins and a third combination or group of combinations, just one spin.

The machine can also allow the sets of reels to be spun in a different order. If they are the same, there is not much point in this, but if they differ, the odds on achieving a spin on the second set of reels obviously change according to which is used as the first set. This choice may be made by the machine, in a random or apparently random manner, or it may be made by the player, using a selection button 17 for example. This may be enabled at all times, in a regular pattern, or in a random or apparently random manner.

The shelf is provided with further buttons 18 in registry with the reels which can serve for "nudging" (i.e. indexing the reels symbol by symbol) or "holding" in known manner, and they will be occasionally enabled by the machine.

We claim:

1. A gaming or amusement machine having a first random selector which, on enablement by player insertion of a coin or token, is operable to produce any of a first plurality of results, and a second separate random selector which is operable when a particular one or more of said first plurality of results is obtained to produce any one of a second plurality of results, at least one of these generating a major prize.

2. A gaming or amusement machine as claimed in claim 1, wherein there are more than two such random selectors forming a sequence, each selector being operable when the previous one in the sequence has produced a particular one or more of a plurality of possible results, the last selector in the sequence generating the major prize.

3. A gaming or amusement machine as claimed in claim 1, wherein minor prizes are generated by certain results from the first selector or from selectors other than the last in the sequence.

4. A gaming or amusement machine as claimed in claim 3, wherein both a minor prize is awarded and operation of the next selector is enabled by one or more results from the up-sequence selector.

5. A gaming or amusement machine as claimed in claim 4 with the modification that the player is offered the choice of taking the minor prize or operating the next selector.

6. A gaming or amusement machine as claimed claim 1, wherein the major prize is only available if the previous selector or selectors produce a single optimum result.

7. A gaming or amusement machine as claimed in claim 1, wherein the second or a down-sequence selector is operable more than once if the up-sequence selector produces one or more particular results.

8. A gaming or amusement machine as claimed in claim 7, wherein the number of operations of the second or down-sequence selector is dependent on said particular results.

9. A gaming or amusement machine as claimed in claim 1, wherein the selectors differ from one another.

10. A gaming or amusement machine as claimed in claim 9, wherein the order of the selectors is changeable.

11. A gaming or amusement machine as claimed in claim 1, wherein at least the first random selector is a set of reels arranged and playable in the manner of a fruit machine.

* * * * *